United States Patent [19]

Davison et al.

[11] Patent Number: 4,528,908

[45] Date of Patent: Jul. 16, 1985

[54] ROTATING AIR CYLINDER DRIVEN HOT INK MARKER

[75] Inventors: Charles F. Davison, Brookfield; Robert M. Myles, Chicago, both of Ill.

[73] Assignee: Norwood Marking & Equipment Co., Inc., Downers Grove, Ill.

[21] Appl. No.: 584,894

[22] Filed: Feb. 29, 1984

[51] Int. Cl.[3] ..... B41F 17/00

[52] U.S. Cl. ..... 101/295; 101/320; 101/359

[58] Field of Search ..... 101/333, 334, 305, 301, 101/310, 314, 315, 327, 35, 41, 44, 295, 291, 298, 297, 320, 321, 324, 326, 359-362; 92/121-125; 74/96, 99 R

[56] References Cited

U.S. PATENT DOCUMENTS

| | | | |
|---|---|---|---|
| 13,308 | 7/1855 | Harris et al. | 101/320 |
| 16,608 | 2/1857 | Ramsay | 101/320 |
| 709,552 | 9/1902 | Morris | 101/321 |
| 1,147,760 | 7/1915 | Sonne-Hansen | 101/319 |
| 2,194,374 | 3/1940 | Wunsch | 92/121 X |
| 2,559,455 | 7/1951 | Meyer | 101/44 |
| 2,936,702 | 5/1960 | Columbus et al. | 101/44 |
| 3,005,405 | 10/1961 | Schubert et al. | 101/41 |
| 3,021,783 | 2/1962 | Casey | 101/35 |
| 3,331,319 | 7/1967 | Martensson | 101/291 |
| 3,706,274 | 12/1972 | Coville | 101/333 |
| 3,724,369 | 4/1973 | Gery et al. | 101/305 X |
| 3,804,016 | 4/1974 | Marozzi et al. | 101/333 |
| 4,073,122 | 2/1978 | Areson | 101/44 X |
| 4,444,108 | 4/1984 | Jenness | 101/305 |

FOREIGN PATENT DOCUMENTS

| | | | |
|---|---|---|---|
| 814791 | 3/1981 | U.S.S.R. | 101/321 |

*Primary Examiner*—Clifford D. Crowder

*Attorney, Agent, or Firm*—Hill, Van Santen, Steadman & Simpson

[57] ABSTRACT

A hot ink imprinter and method wherein a print head carrying a marking type face is swingingly supported by shafts extended through a pivotable mounting block for cyclical swinging, in one phase of which type face carried by the head effects imprinting of a workpiece, and in a second phase of which the type face is caused in the swinging of the head to roll in ink pickup relation on a rotary applicator inking roll. An air cylinder actuator may be provided for controlling swinging of the print head during pivoting and reciprocating movement of the shafts and a cam track engaged by a cam follower on the print head may be used to guide the print head in a defined path.

8 Claims, 6 Drawing Figures

ROTATING AIR CYLINDER DRIVEN HOT INK MARKER

BACKGROUND OF THE INVENTION

1. Field of the Invention

This invention relates to marking devices or imprinters, and is more particularly concerned with a hot ink imprinter with swinging print head, especially adapted for imprinting marks on workpieces advanced in stop and go intemittent fashion.

Imprinters are used in industry for imprinting indicia on workpieces such as bagging or other packaging material in strip form, and the like. For workpieces that travel continuously, rotary head imprinters have been developed. For materials that travel in a stop and go intermittent fashion, such as bag-making material in connection with bag filling equipment, imprinters with stamping type print heads utilizing inked ribbon or transfer tape have been developed. Printers utilizing stamp pads or ink cartridges have also been developed for such situations.

Recently developed rotary head imprinters desirably utilize inking rolls impregnated with pigment or ink that is heat-softenable and which will herein be referred to generically as "ink". Type carried by the rotary print head roll contacts the inking roll in each revolution of the print head for ink transfer onto the type faces. Such inking rolls have the advantage that they are usually mounted in a quick-release fashion for quick replacement or exchange as required and are advantageous, because of the ease and speed with which changes can be made for such purposes as ink replenishment, ink color changes, and the like.

SUMMARY OF THE INVENTION

An important object of the present invention is to provide a new and improved imprinter, particularly of the hot ink type which in a simple, efficient and economical manner adapts the use of an inking roll to a generally rectilinearly operating stamping imprint marker.

Another object of the present invention is to provide a new and improved hot ink imprinter with a swinging print head operating cyclically between an ink applicator and imprinting back-up means at a print station.

According to the present invention there is provided a hot ink imprinter, comprising anvil means for supporting a workpiece to be imprinted, a rotatable hot ink applicator roll, a pair of parallel guide rods or shafts reciprocatively mounted at one end in a pivotable guide housing, a print head carrying imprinting means and mounted on an opposite end of the guide rods, actuator means for pivoting the guide housing and reciprocating the guide rods through a crank arm and link means attached to the print head, and cam track means operative in conjunction with the pivoting and reciprocating movement produced by the actuator means for causing the print head to swing back and forth cyclically for, in one phase of the cycle causing the imprinting means to roll on the hot ink applicator roll for applying ink to the imprinting means, and in a second phase of the cycle imprinting the workpiece on the anvil means.

The present invention also provides a hot ink imprinter, comprising a print head carrying marking means, anvil means, a rotary hot ink applicator roll spaced from the anvil means, and means for cyclically swinging the print head for ink pickup rolling engagement of the marking means with the applicator roll and then imprinting engagement of the marking means with a workpiece on the anvil means.

Further in accordance with the principles of the present invention there is provided a method of hot ink imprinting, comprising providing a swinging printing head carrying marking means, providing imprinting anvil means, and swinging the printing head cyclically comprising in a first phase effecting ink pickup rolling of the marking means with a rotary hot ink applicator roll spaced from the anvil means, and in a second phase moving the print head with the inked marking means in an imprinting stroke engaging the imprinting means with a workpiece at the anvil means.

BRIEF DESCRIPTION OF THE DRAWINGS

Other objects, features and advantages of the present invention will be readily apparent from the following description of certain preferred embodiments thereof, taken in conjunction with the accompanying drawings, although variations and modifications may be effected without departing from the spirit and scope of the novel concepts of the embodiments of the disclosure, and in which.

DESCRIPTION OF THE PREFERRED EMBODIMENTS

Figure 1:
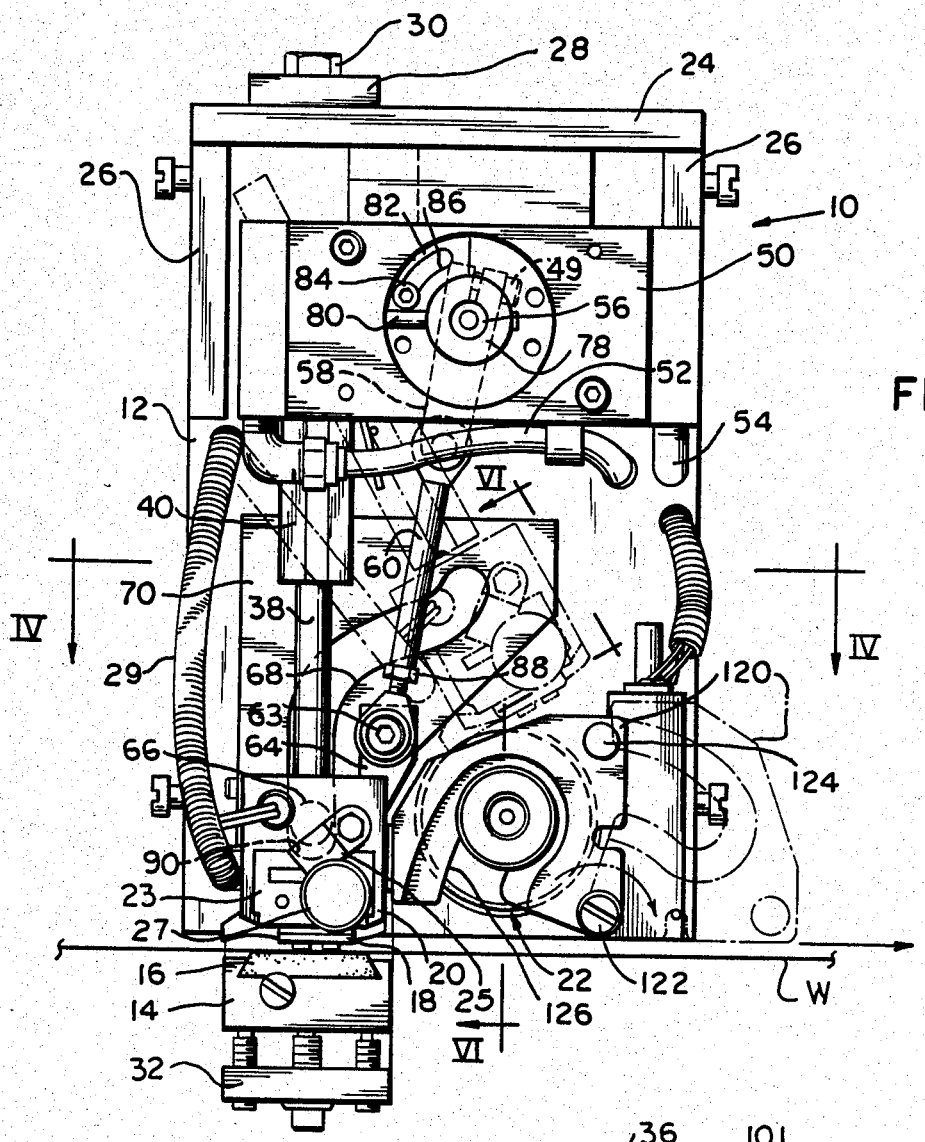
FIG. 1 is a front elevational view of a hot ink imprinter embodying aspects of the invention.
Figure 4:
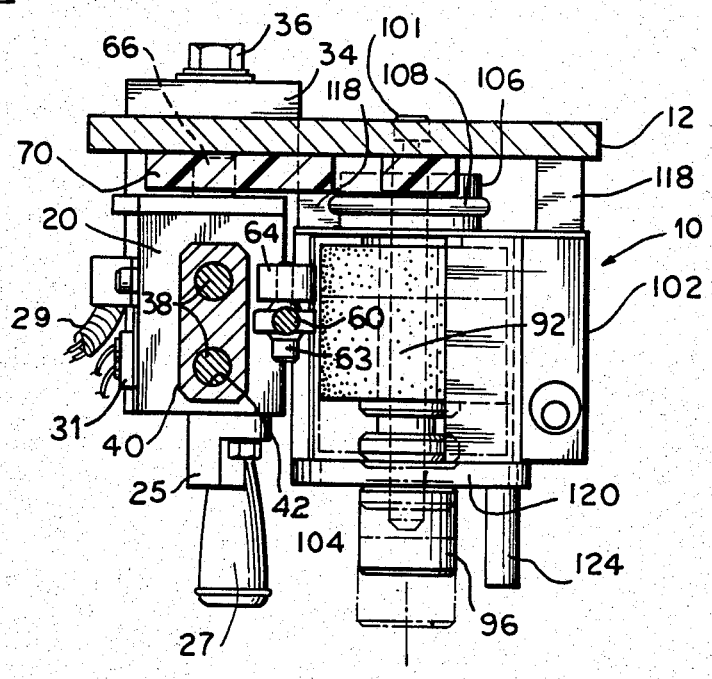
FIG. 4 is a sectional detailed view taken substantially along the line IV—IV in FIG. 1.

A hot ink imprinter 10 as depicted in FIGS. 1–6 comprises a fairly compact arrangement including a frame panel or base member 12 desirably in the form of a vertical plate supporting on its lower portion print station means comprising an anvil 14 equipped with a pressure pad 16 past which a workpiece W can be moved and which provides a back up for the workpiece during imprinting to be supported for imprinting by means of removable type faces 18 carried by a heated print head 20 which is cyclically swingable for effecting rolling ink pickup of the type faces 18 with a rotary hot ink applicator roll 22. The type faces 18 are carried in a removable tray 23 held in place by a pivotable latch member 25 and removable by means of handle 27. The print head heater includes an electrical heating coil energized through electrical wire 29 and controlled by thermostat 31. The imprinter 10 may be employed to imprint selected areas of what may be pre-printed film panels, and is especially useful where the workpiece W is a continuous web or film strip and which may comprise a longitudinally extending series of the panels that may subsequently form individual faces of bags or packages in a packaging or filling machine. In such a machine the work W is generally advanced in a stop and go fashion wherein the panels or work areas of the work to be imprinted are moved into position on the anvil 14 while the print head 20 in coordinated relation moves in the inking phase of its operating cycle and then as the workpiece W comes to a stop the print head 20 functions in the imprinting stroke of the cycle. The frame panel 12 is attached to a top plate 24 by means of right and left gussets 26, FIGS. 1, 2, 3 and 5. Means for mounting the imprinter 10 may be used to secure the imprinter 10 in an operating position and/or in association with apparatus for processing the workpiece W for whatever purpose is desired. As shown, the mounting means includes a bar 28 secured to the top plate 24 as by means of a bolt 30. The bar 28 projects forwardly in a generally overhanging relation to the anvil 14. The anvil 14 is mounted on a generally L-shaped bracket comprising a horizontal supporting arm 32 underlying the anvil 14 and a vertical arm 34 secured to the back of the frame panel 12 by means of bolts 36 which extend through vertical adjustment slots in the arm 34. In mounting the imprinter 10 by means of the bolt 30, the imprinter may be swiveled about the axis of the bolt 30 for adjustment purposes and will then be held in the adjusted position by tightening of the bolt.

In a preferred arrangement, the print head 20 is mounted on one end of a pair of parallel rods or guide shafts 38 which are slidably mounted in a guide block 40. Linear bearings are provided in the interior of the guide block for assisting movement of the guide shafts 38 within the block 40. Passages 42 FIGS. 2 and 4) extend all the way through the guide block 40 allowing the guide shafts 38 to pass completely through the guide block during their reciprocatory motion.

Figure 2:
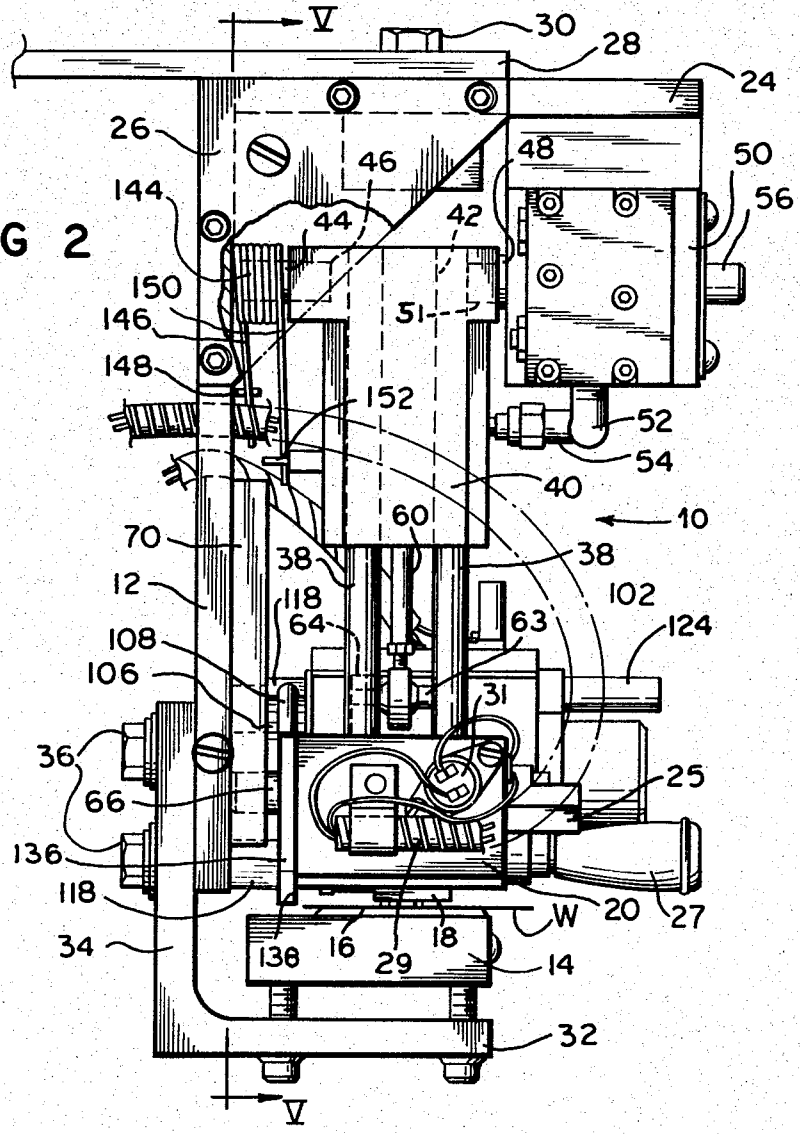
FIG. 2 is a left side elevational view of the imprinter of FIG. 1.
Figure 5:
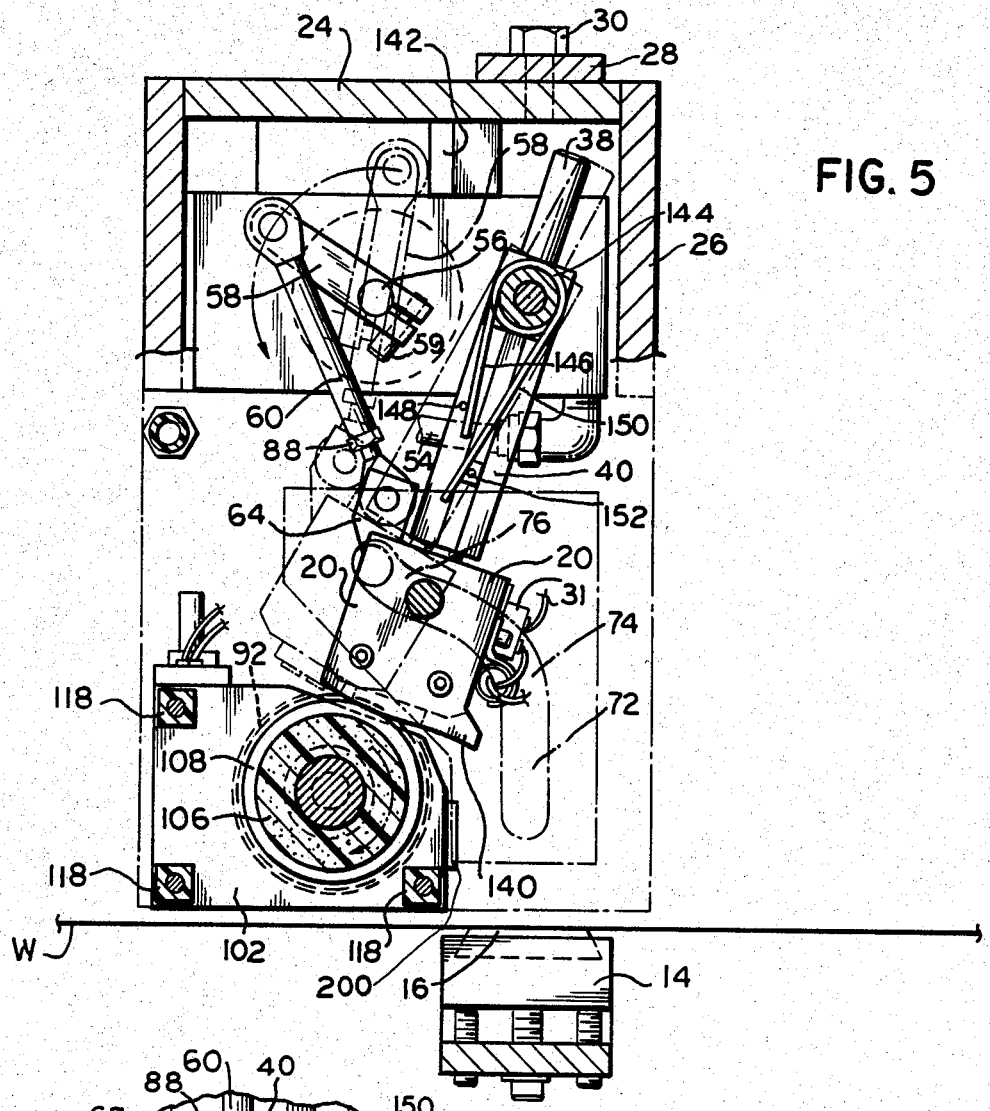
FIG. 5 is a rear sectional view taken substantially along the line V—V in FIG. 2.

As best seen in FIGS. 2 and 5, the guide block 40 is pivotally mounted near a top end by means of a first pivot pin 44 mounted in the frame panel 12 which is captured in an aperture 46 in the block 40. A second pin 48 is projectingly mounted in an actuator block 50 and is coaxial with the first pin 44 and is received in an opposite aperture 51 in the mounting block 40. These opposed pins 44, 48, provide the pivoting axis for the mounting block 40.

The actuator block 50 (FIGS. 1, 2, 3) contains an air driven rotary actuator cylinder, such as one available from PHD, Inc., which is pneumatically driven by air entering through conduits 52, 54 from a source of air pressure (not shown). The actuator rotates a shaft 56, which extends through the actuator block 50, in an alternating rotary motion of less than 360 degrees. Attached to a rearwardly projecting portion of the shaft 56 is a crank arm 58 which can be clamped to the shaft 56 by means of a threaded fastener 59.

The crank arm 58 is pivotally attached to a link member 60 by means of a horizontal pivot pin 62 extending through openings in overlapping ends of the crank arm 58 and the link member 60. The link member 60 is pivotally attached at an opposite end to the print head 20 by means of a horizontally disposed pivot pin 63 mounted on an extension 64 of the print head 20.

Extending from a rear side of the print head 20 is a guide pin or cam follower 66 which is received within a cam track 68 formed in a plate 70 secured to the frame panel 12 by appropriate fastening means. The cam track 68 comprises a substantially vertical lower portion 72, a first curving transition portion 74 comprising approximately one sixth of a full circle in which the slope of the cam track continuously decreases, and a third upper portion 76 which is curved oppositely to the transition portion 74 in which the slope continuously increases.

In a preferred construction, the printing ink applicator 22 comprises a freely rotatably mounted porous elastomeric roll 92 (FIGS. 1, 4, 5 and 6) impregnated with a heat liquifiable inking pigment and provided with a bushing or sleeve hub 94 equipped at its outer end with a manipulating handle 96. In a rearwardly opening bore 98, the hub 94 receives a supporting spindle 100 which is secured as by means of a screw 101 to the frame member 12. A heater block 102 with a heating chamber cavity 104 accommodates the roll 92 in substantially surrounded relation except for a portion of the perimeter of the roll 92, which is exposed at an opening from the cavity oriented in a generally upward and leftward direction as viewed in FIG. 1, for inking cooperation with the print head 20. The heater block 102 has an electrical heating coil therein energized through electrical line 105 and controlled by a thermostat 107.

The heating block 102 is spaced from the frame member 12 by insulating spacers 118 and carried on the spindle 100 is a wheel 106 carrying an O-ring type tire 108 around an outer circumference. The wheel 106 has forwardly extending ears or fingers 110 which coact with ears or fingers 112 on the sleeve hub 94 to provide co-rotation between the wheel 106 and the hub 94. The wheeel 106 is journalled in an opening 114 in a rear wall 116 of the heater block 102. The heater block 102 is spaced from the frame member 12 by insulating spacers 118.

For quick releasably retaining of the inking roll 92 in the heater block 102, a combination closure and latch plate 120 is mounted on the front face of the heater block 102 and is dimensioned to extend in substantially closing relation across the front opening into the cavity 104. Retention of the latch plate 120 releasably in its latching position, is effected by means of a threaded stud 122 secured to the lower right portion of the heater block 102 and providing a pivot for the latch plate 120. Manipulation of the latch plate 120 is facilitated by means of a forwardly projecting insulated post 124 located on the upper end of the latch plate 120 above the mounting stud 122 so that by grasping the post and rotating to the right about the stud, swinging the latch plate away from the inking roll 92 is permitted by a clearance slot 126 which clears the hub 94, as seen in FIG. 1.

To permit axial adjustments of the inking roll 92 for different imprinting requirements, the hub 94 on which the inking roll 92 is mounted is provided with a pair of adjacent axially spaced matching grooves 128 which are retainingly engageable the latch plate 120. The axially outermost of the grooves is defined between the inner end of the handle knob 96 and a radial spacer flange 130, while the next adjacent of the grooves 128 is defined between that flange 130 and a second such flange 132 spaced therefrom. To facilitate axial adjustment of the inking roll assembly to and between the two possible positions, the interdigitated slidably adjustable coupling fingers 110, 112 are sufficiently long to compensate for this axial movement. Through this arrangement, the axial position of the inking roll 92 is easily adjusted for either of the two axial positions by selectively engaging the latch plate 120 in either of the grooves 128. Removal and replacement of the inking roll may be effected in the expeditious manner described above.

Figure 3:
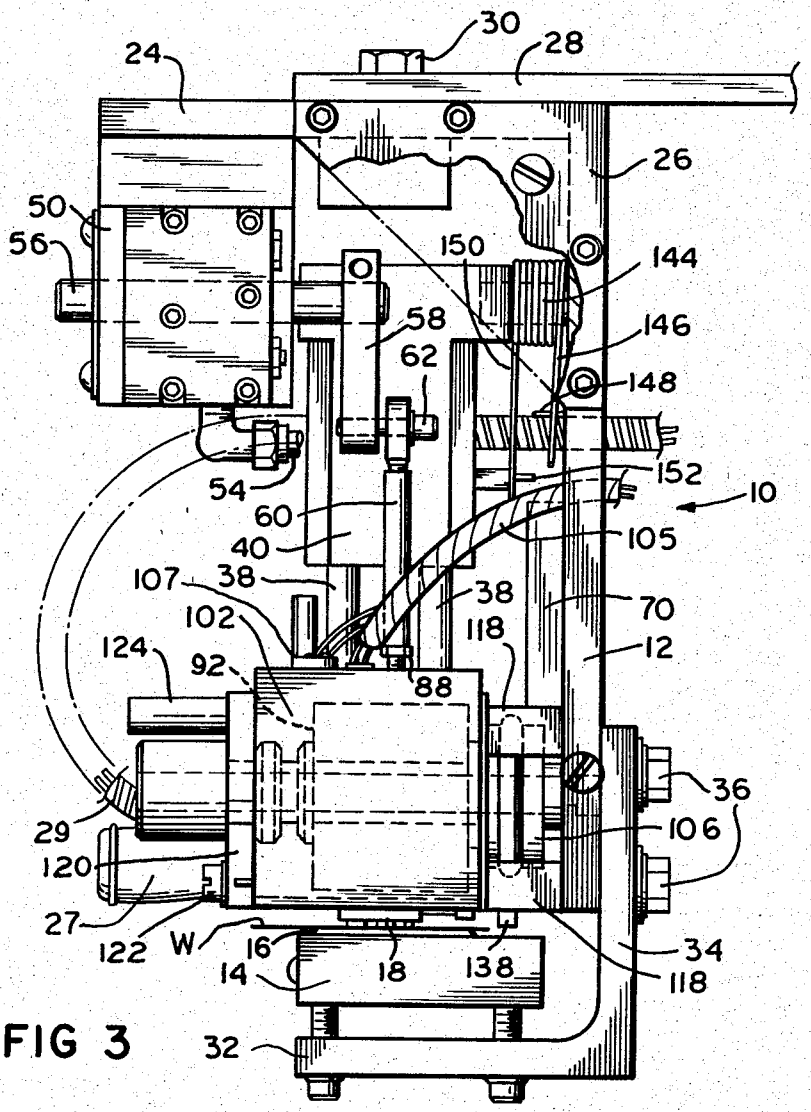
FIG. 3 is a right side elevational view of the imprinter of FIG. 1.

In operation, the print head 20 may be at a first, or imprint, position as shown in FIGS. 1, 2 and 3 in which the type 18 is pressed against the workpiece W and against the pressure pad 16 on the anvil 14. When the head 20 is in its full down position, a contact button 200, carried by heater block 102 (FIG. 5) engages the side of head 20 to bias it and thereby the cam follower 66 toward the opposite side of the vertical lower portion 72 of the cam slot 68 to thereby stabilize the head 20 at the time of imprint. In this position, the guide shafts 38 are in their full extended position relative to the guide block 40 and the crank arm 58 and link member 60 are also nearly in the full extended position. The actuator shaft 56 includes a ring 78 with a projecting pin 80 which rotates with the shaft 56. The pin 80 swings through an arc upon rotation of the shaft 56. A movable stop block 82, held in position by a fastening means 84 passing through an adjustment slot 86 is positioned to form a stop to prevent rotation of the shaft which would cause complete extension or movement of the crank 58 and link member 60 beyond a center position. This prevents the mechanism from going beyond the over-center position, since the crank 58 and link member 60 will remain in a slightly cocked relationship when the print head 20 is in the most downward position. An adjusting means 88 such as a turnbuckle type connection in the link member 60 allows for precise adjustment of the length of the link member to assure that the print head 20 will be extended to the correct degree prior to alignment of the crank arm 58 and link member 60. Also, the cam track 68 extends downwardly slightly farther than the guide pin 66 extending from the print head 20 will travel, thus leaving a small space 90 to prevent jarring of the pin 66 against the end of the cam track.

From the position shown in FIGS. 1, 2 and 3, the air flowing to the actuator will cause the actuator shaft to rotate in the counterclockwise direction as viewed in FIG. 1 causing the crank arm 58 and link member 60 to move further out of alignment thereby shortening the distance between the actuator shaft 56 and the crank arm pivot 62. This causes the print head 20 to move upwardly, in a direction defined by the cam track 68. As this occurs, the guide shafts 38 slide upwardly in the block 40. As the guide pin 66 moves into the transition area 74, the print head begins to swing laterally while still moving upwardly. This is facilitated by the pivotal connection of the guide block 40.

Figure 6:
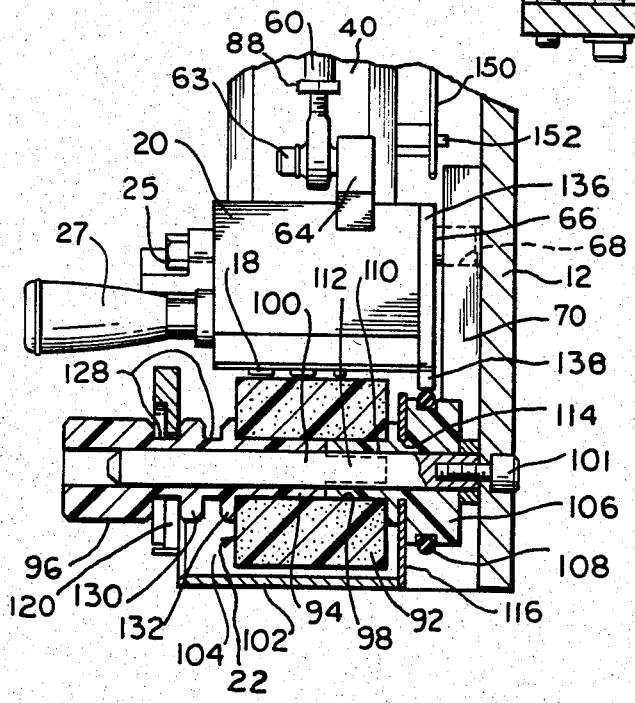
FIG. 6 is a partial detailed view taken substantially along the line VI—VI in FIG. 1.

As the print head 20 moves upwardly and laterally as guided by the cam follower 66 in the cam track 68, the type 18 moves into engagement with the outer circumference of the ink roll 92, as seen in FIGS. 5 and 6. At the same time, a rear wall 136 of the print head 20, has a downwardly extending portion or shoe 138 which engages the O-ring tire 108 on the spindle wheel 106. As the print head continues its upwardly swinging movement, the engagement between the type and ink roll 92 and the shoe 138 and the tire 108 causes the roller to rotate in a clockwise direction as seen in FIG. 1, or in a counterclockwise direction as seen in the rear view of FIG. 5. The rolling of the ink roll 92 reduces the frictional engagement between the type 18 and the roll 92 to prevent any rubbing between those two elements. Further upward swinging movement of the print head 20 lifts the print head clear of the roll 92; however, the wall 136 has a downwardly curved end tab 140 at the trailing end of the upswinging shoe 138, as seen in FIG. 5, which continues in engagement with the tire 108. In this manner, the roll 92 is prevented from free-rolling during upward movement of the print head 20.

As the crank arm 58 continues its clockwise motion, as viewed from the rear in FIG. 5, it reaches a point of approximately 180° opposite its initial position shown in FIG. 1 and further motion is prevented by a resilient stop member 142 which is secured to the top plate 24. A spring 144 (FIGS. 1, 2 and 5) is mounted on the pivot pin 44 having a first arm 146 acting against a stationary stop pin 148 mounted on the base frame 12 and a second arm 150 acting against a stop pin 152 mounted on the pivotable guide housing 40. As the guide housing 40 pivots, tension is increased in the spring 144 to a maximum tension when the crank arm 58 has moved to its farthest rotational point in abutment with stop member 142. At this point in the operation, the air flow in conduits 52, 54 may be reversed and the rotation of the actuator shaft 56 is also reversed. The tension of spring 144 assists the crank arm 58 in reversing its direction. As the crank arm 58 continues its reversed motion, the print head 20 retraces its path downwardly and laterally, again rolling across the ink roller 92 and downwardly to allow the ink coated type 18 to engage with the workpiece W. A principal function of the torsion spring is to provide decelleration of the upswinging print head 20 after the type 18 passes the roll 92 toward the dot-dash phantom portion in FIG. 5.

As the rotary motion of the actuator shaft 56 is converted into the motion defined by the cam track 68, the speed of the print head 20 varies depending on the angular position of the crank arm 58 relative to the link member 60. As the crank arm approaches its most downward or most upward position, the speed of the print head diminishes until the speed is stopped momentarily while the crank arm changes direction. Thus, as the print head approaches the anvil 14, its speed diminishes and it makes a crisp, clear imprint on the workpiece W while the workpiece W is momentarily stopped.

The speed of the print head 20 is maximized when the crank arm 58 is at right angles to the link member 60. This occurs just prior to the type 18 engaging or disengaging with the roll member 92 in the upward or downward movement of the print head. As the type face disengages from the roll 92, and thus the shoe 138 disengages from the O-ring 108, the print head 20 is approaching its maximum return swing speed. This speed is imparted to the roll 92. As the shoe 138 disengages from the O-ring 108, the roll 92 is left to freely spin on the spindle 100. The free spinning is relatively short-lived and generally stops prior to shoe 138 or type 18 reengaging with respect to the roll 92 in a subsequent cycle. Therefore, there is no scuffing of the roll 92 against the type 18.

It will be understood that variations and modifications may be effected without departing from the spirit and scope of the novel concepts of this invention.

We claim as our invention:

1. A hot ink imprinter comprising:

anvil means for backing up a workpiece to be imprinted;

a rotatably mounted normally free-wheeling hot ink applicator roll;

a drive roll coaxially and co-rotatively connected to said hot ink applicator roll;

a guide block mounted on a pivot and having a shaft passage therethrough on an axis perpendicular to the axis of said pivot;

shaft means extending at a first end through said block shaft passage for reciprocatory movement;

a print head carrying imprinting means and mounted on a second end of said shaft means;

actuator means linked to said print head for reciprocating said print head between a print position and an extreme position as guided by reciprocation of said shaft means in said passage and for pivoting said head as permitted by pivoting of said guide block on its pivot;

a cam track means for defining a path to be followed by said print head during said reciprocating and pivoting of the print head;

said print head including a cam follower means engageable with said cam track means and a downwardly extending shoe along one side thereof, said shoe having a rear projection; and said cam track means, said print head, said hot ink applicator roll and said drive roll being disposed for operating in combination during reciprocating and pivoting of said print head as said print head moves from said printing position to said extreme position for guiding said imprinting means into engagement with said hot ink applicator for applying ink thereto and simultaneously guiding said shoe into engagement with said drive roll for rotating said hot ink applicator for even transfer of ink to said imprinting means, said rear projection of said shoe disposed for remaining in engagement with said drive roll after said imprinting means disengages said hot ink applicator roll for preventing free-wheeling of said hot ink applicator roll as said print head moves to said extreme position, and said imprinter means again engaging said hot ink applicator roll as said print head moves to said print position for further applying ink thereto and said shoe rotating said drive roll in an opposite direction and disengaging said drive roll after said imprinter means disengages said hot ink applicator roll for permitting free-wheeling of said hot ink applicator roll.

2. A hot ink imprinter as claimed in claim 1 wherein said shaft means comprises a plurality of parallel shafts extending through said guide block.

3. A hot ink imprinter as claimed in claim 1 wherein said actuator means comprises a rotating air cylinder driven by an alternating pressurized air source.

4. A hot ink imprinter as claimed in claim 1 wherein said actuator means includes an actuator shaft and wherein said print head is linked to said actuator shaft by a crank arm secured to said shaft and a link member pivotally connected at one end to said crank arm and pivotally connected at an opposite end to said print head.

5. A hot ink imprinter as claimed in claim 1 wherein said actuator means is a pneumatically driven rotary actuator which oscillates within a rotary range of less than 360 degrees.

6. A hot ink imprinter as claimed in claim 1 wherein each of the guide block, actuator means and hot ink applicator roll has an axis of rotation, the axis of rotation of the guide block being spaced laterally from the axis of rotation of the actuator means and from the axis of rotation of the hot ink applicator roll.

7. A hot ink imprinter as claimed in claim 1 further comprising means for decelerating the print head toward said extreme position and for urging the print head toward the printing position in combination with said actuator means after said print head reaches said extreme position.

8. An imprinter as claimed in claim 1 further comprising an O-ring carried on said drive roll, said O-ring positioned for engaging said shoe of said print head during reciprocating and pivoting of said print head.

* * * * *